US010818424B2

(12) United States Patent
Yoon et al.

(10) Patent No.: US 10,818,424 B2
(45) Date of Patent: Oct. 27, 2020

(54) COIL COMPONENT

(71) Applicant: Samsung Electro-Mechanics, Co., Ltd., Suwon-si, Gyeonggi-do (KR)

(72) Inventors: Chan Yoon, Suwon-si (KR); Young Ghyu Ahn, Suwon-si (KR); Dong Hwan Lee, Suwon-si (KR); Jin Ho Ku, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 1 day.

(21) Appl. No.: 15/451,822

(22) Filed: Mar. 7, 2017

(65) Prior Publication Data

US 2018/0047494 A1 Feb. 15, 2018

(30) Foreign Application Priority Data

Aug. 9, 2016 (KR) ..... 10-2016-0101335

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 17/00*** | (2006.01) |
| ***H01F 17/04*** | (2006.01) |
| ***H01F 27/245*** | (2006.01) |
| ***H01F 41/02*** | (2006.01) |
| ***H01F 41/04*** | (2006.01) |

(52) U.S. Cl.

CPC ..... *H01F 27/2804* (2013.01); *H01F 17/0013* (2013.01); *H01F 17/04* (2013.01); *H01F 27/245* (2013.01); *H01F 27/292* (2013.01); *H01F 41/0233* (2013.01); *H01F 41/042* (2013.01); *H01F 2017/048* (2013.01); *H01F 2027/2809* (2013.01)

(58) Field of Classification Search

CPC .... H01F 27/292; H01F 27/2804; H01F 27/29; H01F 2027/2809; H01F 27/2852

USPC ..... 336/200

See application file for complete search history.

(56) References Cited

U.S. PATENT DOCUMENTS 4,342,143 A * 8/1982 Jennings ..... H01F 17/0013 257/E27.114
5,392,019 A * 2/1995 Ohkubo ..... H01F 17/0013 333/185
5,572,179 A * 11/1996 Ito ..... H01F 17/0006 336/200

(Continued)

FOREIGN PATENT DOCUMENTS

JP 2010-062502 A 3/2010
JP 2010062502 A * 3/2010

(Continued)

*Primary Examiner* — Elvin G Enad
*Assistant Examiner* — Joselito Baisa
(74) *Attorney, Agent, or Firm* — Morgan, Lewis & Bockius LLP

(57) ABSTRACT

A coil component includes: a body in which a support member is disposed; and first and second coil conductors formed on first and second surfaces of the support member, respectively, the second surface of the support member opposing the first surface thereof, and including first and second lead portions extended to be exposed to the outside of the body, respectively. The first and second lead portions are formed in corner regions of the body.

20 Claims, 5 Drawing Sheets

(56) References Cited

U.S. PATENT DOCUMENTS 6,549,112 B1 * 4/2003 Gallina ..... H01F 5/003 336/200
6,715,197 B2 * 4/2004 Okuyama ..... H01F 17/0013 29/592.1
6,791,445 B2 * 9/2004 Shibata ..... H01F 17/04 336/83
6,980,075 B2 * 12/2005 Mheen ..... H01F 17/0006 257/531
7,812,700 B2 * 10/2010 Yoshimoto ..... H01F 17/045 336/192
8,193,894 B2 * 6/2012 Miyoshi ..... H01F 17/0013 29/602.1
8,264,316 B2 * 9/2012 Miura ..... H01F 27/29 336/192
8,362,865 B2 * 1/2013 Banno ..... H01F 17/0013 336/200
8,941,457 B2 * 1/2015 Yan ..... H01F 5/003 336/200
9,058,927 B2 * 6/2015 Takezawa ..... H01F 27/2804
9,236,171 B2 * 1/2016 Ito ..... H01F 17/04
9,847,162 B2 * 12/2017 Nishiyama ..... H01F 17/0013
9,859,043 B2 * 1/2018 Yan ..... H01F 1/26
2002/0158739 A1 * 10/2002 Shibata ..... H01F 17/04 336/90
2005/0030143 A9 * 2/2005 Satoh ..... A61B 8/08 336/200
2010/0007451 A1 * 1/2010 Yan ..... H01F 17/043 336/90
2010/0141370 A1 * 6/2010 Lu ..... H01F 17/0013 336/200
2011/0075880 A1 * 3/2011 Kamimura ..... H04R 1/06 381/413
2011/0279211 A1 * 11/2011 Miura ..... H01F 27/29 336/192
2013/0015937 A1 * 1/2013 Seko ..... H01F 41/043 336/200
2015/0179334 A1 * 6/2015 Jeong ..... H05K 1/165 361/782
2016/0172100 A1 * 6/2016 Ishida ..... H01F 27/29 336/192

FOREIGN PATENT DOCUMENTS

KR 10-2014-0038780 A 3/2014
KR 10-2014-0038781 A 3/2014

* cited by examiner

COIL COMPONENT

CROSS-REFERENCE TO RELATED APPLICATION(S)

This application claims the benefit of priority to Korean Patent Application No. 10-2016-0101335, filed on Aug. 9, 2016 in the Korean Intellectual Property Office, the entire disclosure of which is incorporated herein by reference.

BACKGROUND

1. Field

The present disclosure relates to a coil component.

2. Description of Related Art

An inductor, which is a type of coil components, is a representative passive element constituting an electronic circuit, together with a resistor and a capacitor, to remove noise.

The inductor as described above may be divided into a winding type inductor, a multilayer type inductor, a thin film type inductor, and the like. Among them, the thin film type inductor is relatively suitable for being thinly manufactured, and thus, recently, the thin film type inductor has been used in various fields.

Meanwhile, in accordance with the recent trend toward complexity, multi-functionalization, and slimness of set components, the demand for electronic components having various sizes, in addition to electronic components having a small size, has increased. As a part of this trend, the demand for an electronic component having a square-shaped lower surface, that is, an electronic component of which a length and a width are equal to each other, has increased.

FIG. 4 is a perspective view illustrating a coil component according to the related art so that a coil conductor of the coil component is viewed. Referring to FIG. 4, the coil component according to the related art includes a body 210, a support member 230 disposed in the body 210, coil conductors 221 and 222 formed on at least one of first and second main surfaces of the support member 230, and external electrodes 241 and 242 formed on outer surfaces of the body 210. Lead portions 221*a* and 222*a* of a coil connecting the coil conductors and the external electrodes to each other are formed on central portions of side surfaces of the body 210 in a width direction.

However, in a case of the coil component having the square shaped lower surface of which a length and a width are equal to each other, since it is impossible to specify a side surface to which the lead portions 221*a* and 222*a* of the coil is led, it is difficult to specify a side surface on which the external electrodes should be formed.

SUMMARY

An aspect of the present disclosure may provide a coil component capable of being easily manufactured.

One of the various solutions suggested in the present disclosure is to form a lead portion of a coil conductor in a corner region of a body.

According to an aspect of the present disclosure, a coil component may include: a body in which a support member is disposed; and first and second coil conductors formed on first and second surfaces of the support member, respectively, the second surface of the support member opposing the first surface thereof, and including first and second lead portions extended to be exposed to the outside of the body, respectively. The first and second lead portions are formed in corner regions of the body.

BRIEF DESCRIPTION OF DRAWINGS

The above and other aspects, features, and advantages of the present disclosure will be more clearly understood from the following detailed description when taken in conjunction with the accompanying drawings, in which.

DETAILED DESCRIPTION

Hereinafter, exemplary embodiments of the present disclosure will be described in detail with reference to the accompanying drawings.

Hereinafter, a coil component according to an exemplary embodiment in the present disclosure, particularly a thin film type inductor, will be described by way of example. However, the coil component of the present disclosure is not necessarily limited to the limitations of the exemplary embodiment.

Figure 1:
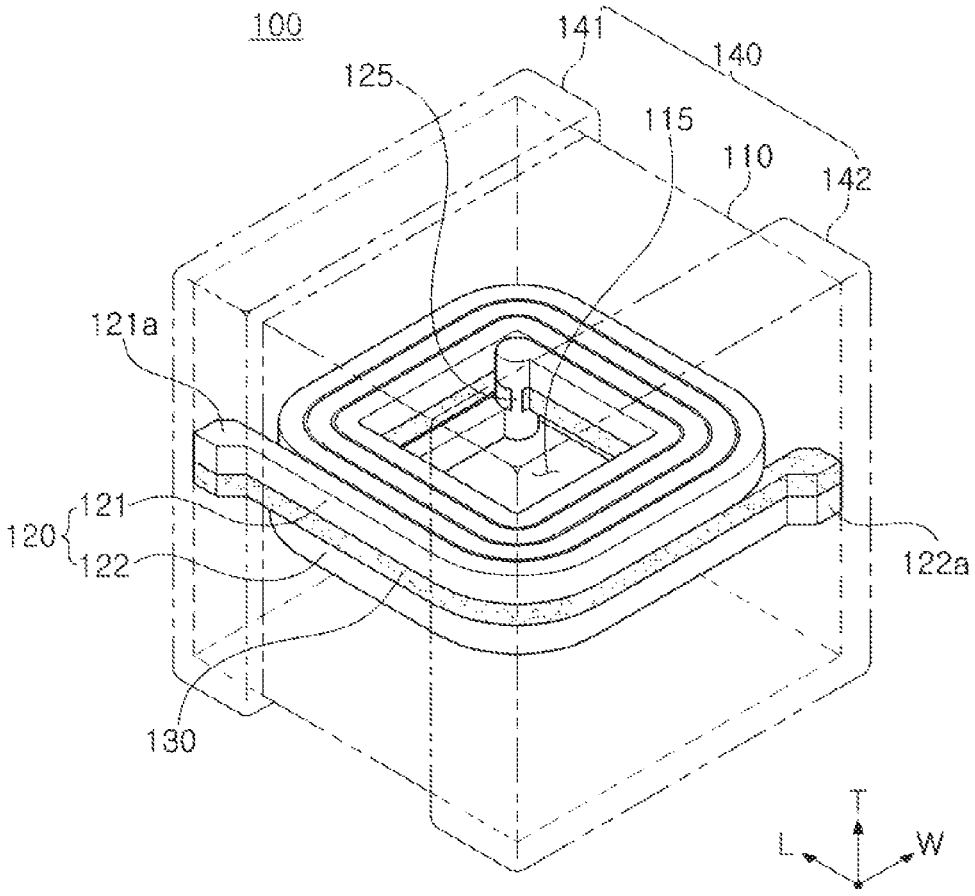
FIG. 1 is a perspective view illustrating a coil component according to an exemplary embodiment in the present disclosure so that a coil conductor of the coil component is viewed.

FIG. 1 is a perspective view illustrating a coil component according to an exemplary embodiment in the present disclosure so that a coil conductor of the coil component is viewed. In this case, in the following description described with reference to FIG. 1, a 'length' direction refers to an 'L' direction of FIG. 1, a 'width' direction refers to a 'W' direction of FIG. 1, and a 'thickness' direction refers to a 'T' direction of FIG. 1.

Referring to FIG. 1, a coil component 100 according to the exemplary embodiment in the present disclosure may include a body 110, a coil conductor 120, a support member 130, and an external electrode 140.

The body 110 may form an exterior of the coil component 100. A shape of the body 110 may be a substantial hexahedron having two end surfaces opposing each other in the length direction, two side surfaces opposing each other in the width direction, and upper and lower surfaces opposing each other in the thickness direction, but is not limited thereto.

A cross section of the body 110 may have a square shape, but is not necessarily limited thereto. However, in a case in which the cross section of the body 110 has the square shape, the present disclosure may be more effectively applied.

The body 110 may contain a magnetic material. The magnetic material is not particularly limited as long as it has a magnetic property. For example, the magnetic material may be a pure iron powder; or the magnetic material may comprise one or more Fe alloys, such as an Fe—Si-based alloy powder, an Fe—Si—Al-based alloy powder, an Fe—Ni-based alloy powder, an Fe—Ni—Mo-based alloy powder, an Fe—Ni—Mo—Cu-based alloy powder, an Fe—Co-based alloy powder, an Fe—Ni—Co-based alloy powder, an Fe—Cr-based alloy powder, an Fe—Cr—Si-based alloy powder, an Fe—Ni—Cr-based alloy powder, an Fe—Cr—Al-based alloy power, or the like; amorphous alloys, such as an Fe-based amorphous alloy, a Co-based amorphous alloy, or the like; spinel type ferrites, such as an Mg—Zn-based ferrite, an Mn—Zn-based ferrite, an Mn—Mg-based ferrite, a Cu—Zn-based ferrite, an Mg—Mn—Sr-based ferrite, an Ni—Zn-based ferrite, or the like; hexagonal ferrites, such as a Ba—Zn-based ferrite, a Ba—Mg-based ferrite, a Ba—Ni-based ferrite, a Ba—Co-based ferrite, a Ba—Ni—Co-based ferrite, or the like, or garnet ferrites, such as a Y-based ferrite, or the like.

The magnetic material may contain a mixture of magnetic metal powder particles and a resin. The magnetic metal powders may contain iron (Fe), chromium (Cr), or silicon (Si) as a main ingredient. For example, the magnetic metal powders may contain iron-nickel (FeNi), iron (Fe), iron-chromium-silicon (FeCrSi), or the like, but are not limited thereto. The resin may include epoxy, polyimide, a liquid crystal polymer (LCP), or the like, or a mixture thereof, but is not limited thereto. The magnetic metal powders may be magnetic metal powders having at least two average particle sizes, $D_1$ and $D_2$. In this case, a magnetic material-resin composite may be fully filled by using and compressing bimodal magnetic metal powder particles having different sizes, such that a packing factor of the magnetic material-resin composite may be increased.

The body 110 may be formed by forming the magnetic material-resin composite containing the mixture of the magnetic metal powder and the resin in a sheet shape and compressing and curing the sheet-shaped magnetic material-resin composite on and below the coil conductor 120, but is not necessarily limited thereto. Here, a stacking direction of the magnetic material-resin composite may be perpendicular to a mounting surface of the coil component. Here, the term "perpendicular" is a concept including a case in which an angle between the stacking direction and the mounting surface is approximately 90°, that is, 60 to 120° or so, in addition to a case in which the angle is exactly 90°.

The support member 130 may be disposed in the body 110 to serve to support the coil conductor 120, and may be, for example, a polypropylene glycol (PPG) substrate, a ferrite substrate, a metal based soft magnetic substrate, or the like. In this case, a through hole may be formed in a central region of the support member 120, and the through hole may be filled with the same material as a material forming the body to form a core part 115. The core part as described above may configure a portion of the body 110.

The coil conductor 120 may be formed on at least one of one surface of the support member 130 and the other surface of the support member 130 opposing the one surface of the support member 130, and in the present exemplary embodiment, a case in which the coil conductor 120 is simultaneously formed on the one surface of the support member 130 and the other surface of the support member 130 opposing the one surface of the support member 130 is illustrated in a state in which high inductance may be obtained. That is, a first coil conductor 121 may be formed on one surface of the support member 130, and a second coil conductor 122 may be formed on the other surface of the support member 130 opposing one surface thereof. In this case, the first and second coil conductors 121 and 122 may be electrically connected to each other through a via hole 125 penetrating through the support member 130. Further, the coil conductor 120 may be formed in a spiral shape, and first and second lead portions 121*a* and 122*a* exposed to the outside of the body 110 may be provided at outermost regions of the spiral shape for electrical connection with external electrodes 141 and 142. Here, the first and second lead portions 121*a* and 122*a* may be formed integrally with the coil conductor 120 while forming portions of outermost regions of the coil conductor 120. The first and second lead portions 121*a* and 122*a* may be exposed to different surfaces of the body 110.

The coil conductor 120 may be formed of a metal having high electrical conductivity, or the like, for example, silver (Ag), palladium (Pd), aluminum (Al), nickel (Ni), titanium (Ti), gold (Au), copper (Cu), platinum (Pt), or an alloy thereof, etc. In this case, as an example of a preferable process for manufacturing a thin film shape, an electroplating method may be used. Alternatively, another process known in the related art may also be used as long as an effect similar to an effect of the electroplating method may be accomplished.

Figure 2A:
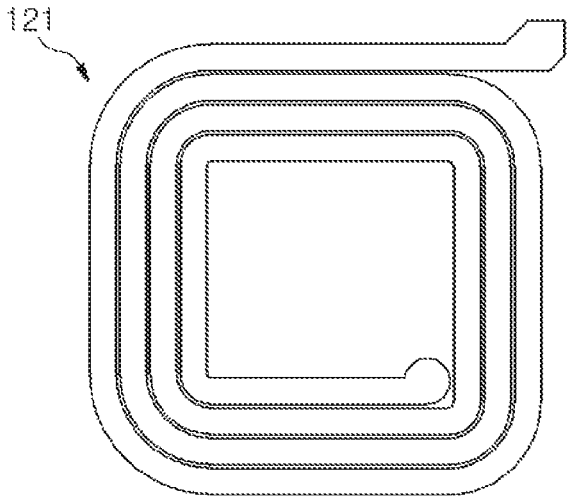
FIGS. 2A and 2B illustrate shapes of first and second coil conductors, respectively, when the coil component according to the exemplary embodiment in the present disclosure is viewed from an upper surface of the coil component.
Figure 2B:
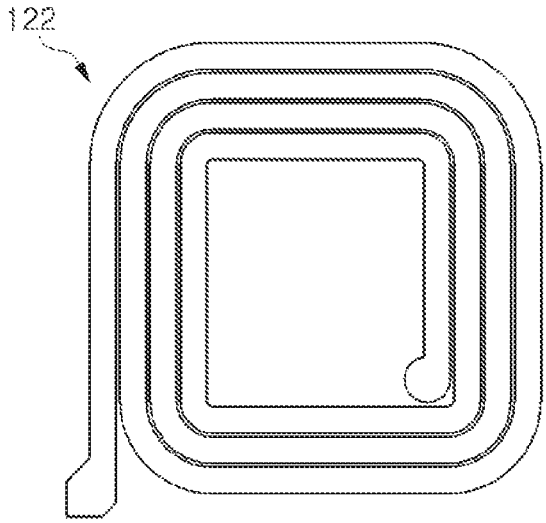

FIGS. 2A and 2B illustrate shapes of first and second coil conductors, respectively, when the coil component according to the exemplary embodiment in the present disclosure is viewed from an upper surface of the coil component.

As described above, in a case of the coil component according to the related art, a lead portion of a coil conductor connecting the coil conductor and external electrodes to each other is formed at a central portion of a side surface of the body in a width direction. Therefore, in a case of a coil component having a square-shaped lower surface, of which a length and a width are equal to each other, since it is impossible to specify a side surface to which a lead portion of a coil conductor is led, it may be difficult to specify a side surface on which external electrodes need to be formed.

Different than this, according to the exemplary embodiment in the present disclosure, the lead portions 121*a* and 122*a* of the coil conductor may be formed in corner regions of the body 110. Therefore, there is no need to specify the surface on which the external electrodes need to be formed, such that manufacturing cost and time of the coil component may be decreased. Meanwhile, here, the term "corner region" is a concept including a corner and a region adjacent to the corner.

Further, according to the exemplary embodiment in the present disclosure, the first and second coil conductors 121 and 122 may be connected to each other through the via hole 125 formed in a corner of a square central portion of the support member 130. As the via hole 125 is formed in the corner of the square central portion of the support member 130 as described above, warpage of a support member may be decreased, such that a yield may be improved.

Meanwhile, referring to FIGS. 2A and 2B, the first and second coil conductors 121 and 122 may be line-symmetrical to each other with respect to one diagonal of the body 110. In this case, at the time of forming the coil conductor using a plating method, distribution of a plating width and plating thickness may be significantly decreased, such that warpage of the support member may be decreased, and thus, the yield may be improved.

Figure 3A:
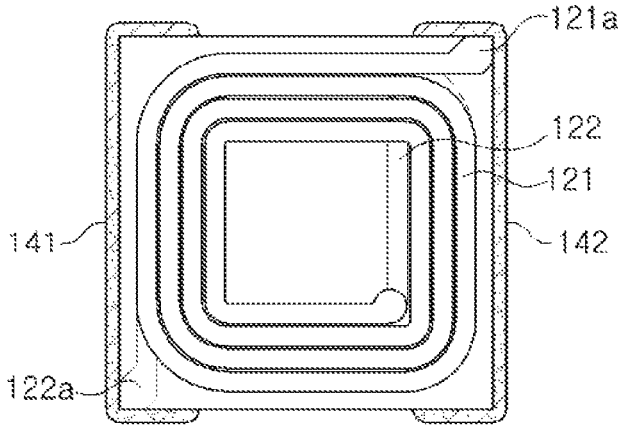
FIGS. 3A through 3C illustrate various modified examples of the shape of the coil conductor.
Figure 3B:
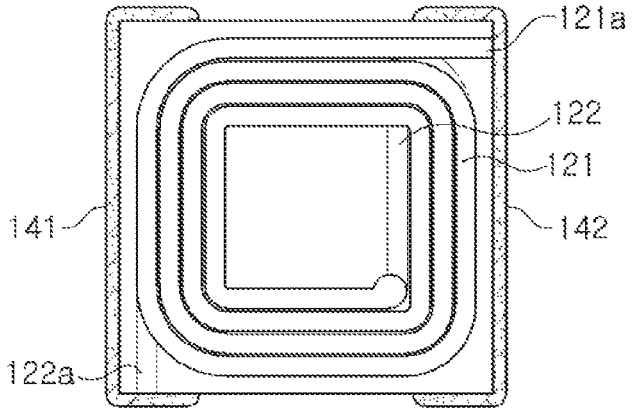
Figure 3C:
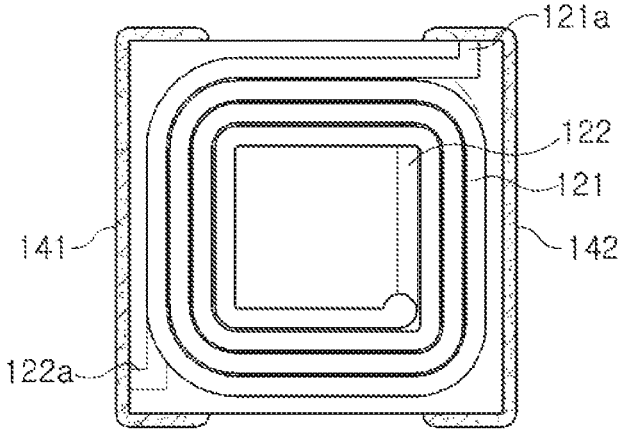
Figure 4:
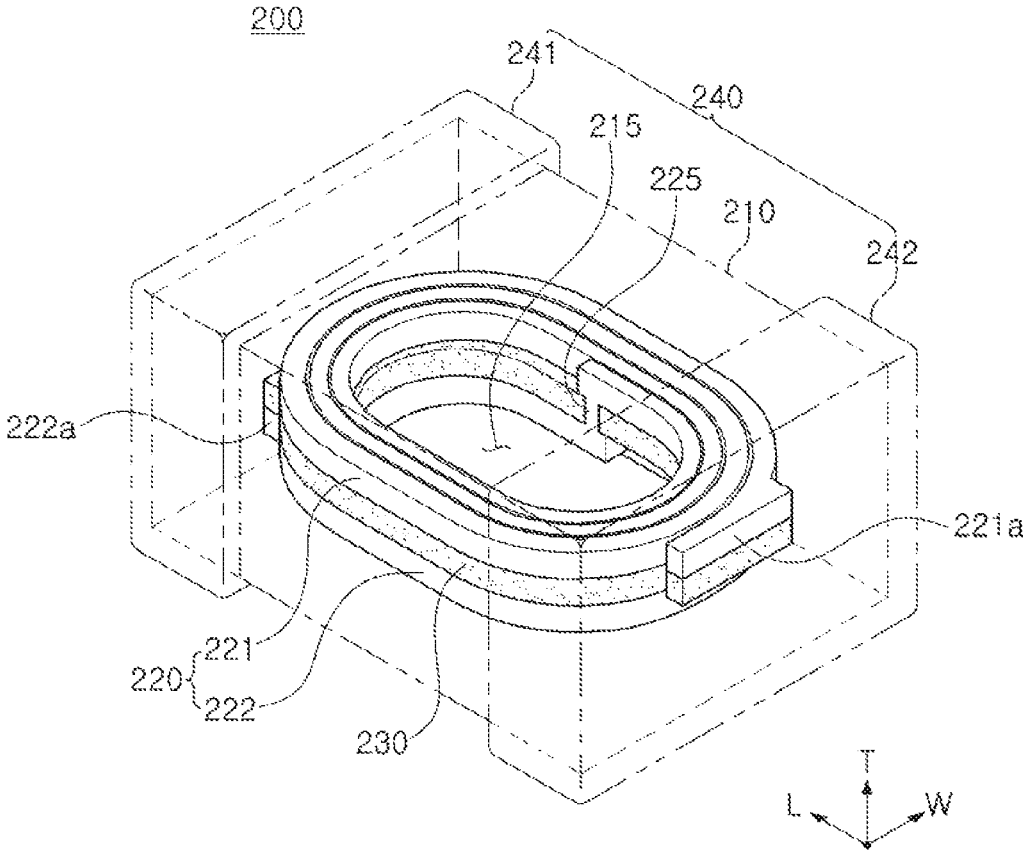
RELATED ART FIG. 4
FIG. 4 is a perspective view illustrating a coil component according to the related art so that a coil conductor of the coil component is viewed.

FIGS. 3A through 3C illustrate various modified examples of the shape of the coil conductor.

That is, each of the lead portions 121*a* and 122*a* of the coil conductor may be led to a corner of the body 110 to thereby be simultaneously exposed to one end surface of the body 110 and one side surface of the body 110 connected to one end surface thereof, as illustrated in FIG. 3A. Alternatively, as illustrated in FIG. 3B or 3C, each of the lead portions 121*a* and 122*a* may be led to the region adjacent to the corner of the body 110 to thereby be exposed only to one side surface or one end surface of the body 110.

The external electrode 140 may serve to electrically connect the coil component 100 to a circuit board, or the like, when the coil component 100 is mounted on the circuit board, or the like.

The external electrode 140 may be connected to the lead portions 121*a* and 121*b*, and formed on the end surfaces of the body 110 in the length direction, but is not necessarily limited thereto.

Meanwhile, according to the exemplary embodiment in the present disclosure, the external electrode 140 may include first and second external electrodes 141 and 142 connected to the first and second lead portions 121*a* and 122*a*, respectively. In this case, the first external electrode 141 may be formed on one end surface of the body 110 and portions of side surfaces of the body 110 connected to one end surface thereof, and the second external electrode 142 may be formed on the other end surface of the body 110 opposing one end surface of the body 110 and portions of side surfaces of the body 110 connected to the other end surface thereof. In some cases, the first and second external electrodes 141 and 142 may be extended to portions of the upper and lower surfaces of the body 110.

Figure 5:
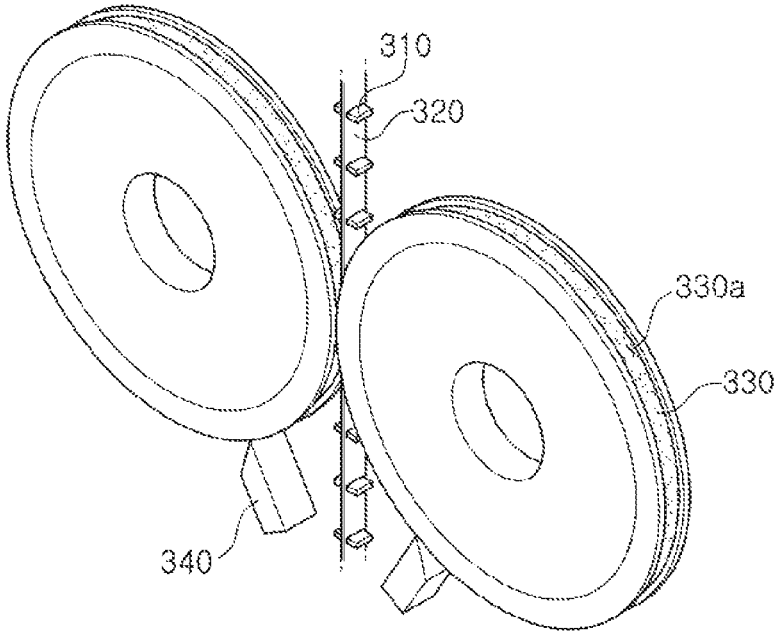
FIG. 5 is a schematic view illustrating an example of an external electrode application apparatus.

FIG. 5 is a schematic view illustrating an example of an external electrode application apparatus.

Referring to FIG. 5, the external electrode application apparatus may include a paste wheel 330 and a blade 340, and a body 310 may be mounted on a carrier tape 320 to thereby be supplied to the paste wheel 330. A groove portion 330*a* may be provided in a circumferential surface of the paste wheel 330, and in a case of rotating the paste wheel 330 in a state in which the groove portion 330*a* as described above is filled with an external electrode paste, the external electrode paste may be applied onto an outer surface of the body 310 contacting the paste wheel 330.

Figure 6A:
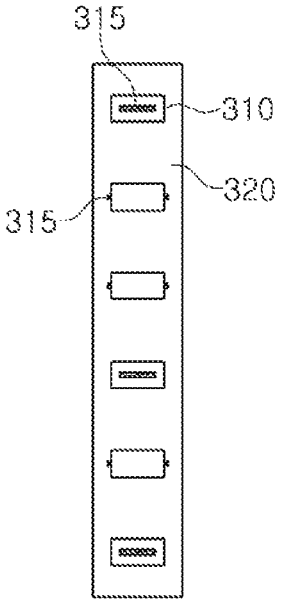
RELATED ART FIG. 6A
FIG. 6A is a view illustrating a case in which the coil component according to the related art is mounted on a carrier tape.
Figure 6B:
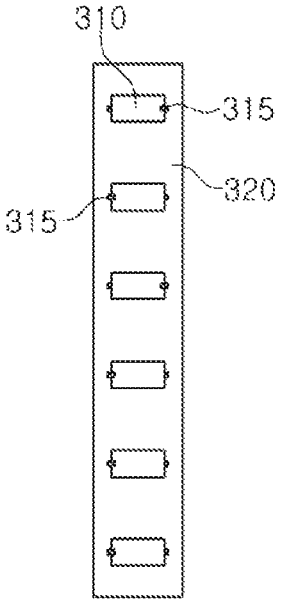
FIG. 6B is a view illustrating a case in which the coil component according to the exemplary embodiment in the present disclosure is mounted on the carrier tape.

FIG. 6A is a view illustrating a case in which the coil component according to the related art is mounted on a carrier tape, and FIG. 6B is a view illustrating a case in which the coil component according to the exemplary embodiment in the present disclosure is mounted on the carrier tape. Referring to FIGS. 6A and 6B, it may be confirmed that in the case of the coil component according to the related art, a problem that the external electrode is not connected to the lead portion may occur, depending on a mounting direction of the body, but, different than this, in the case of the coil component according to the exemplary embodiment in the present disclosure, the external electrode may be connected to the lead portion regardless of a mounting direction of the body.

As set forth above, according to the exemplary embodiment in the present disclosure, since there is no need to specify the surface on which the external electrodes need to be formed, the cost and time of manufacturing the coil component may be decreased.

While exemplary embodiments have been shown and described above, it will be apparent to those skilled in the art that modifications and variations could be made without departing from the scope of the present invention as defined by the appended claims.

What is claimed is:

1. A coil component comprising:

a body in which a support member is disposed;

first and second coil conductors disposed on first and second surfaces of the support member, respectively, the second surface of the support member opposing the first surface thereof, and including first and second lead portions, respectively; and first and second external electrodes disposed on outer surfaces of the body and connected to the first and second lead portions, respectively, wherein the first and second lead portions are disposed in respective corner regions of the body and are each exposed to outside the body through adjacent outermost side-surfaces of the body, wherein the first and second coil conductors are connected to each other through a via hole disposed in a corner of a square central portion of the support member, wherein the body has a square-shaped cross section, wherein the first external electrode is disposed on a first end surface of the body and on portions of side surfaces of the body connected to the first end surface, and the second external electrode is disposed on a second end surface of the body opposing the first end surface of the body and on portions of side surfaces of the body connected to the second end surface, wherein corner regions of the body other than said respective corner regions are spaced apart from the first and second coil conductors by corresponding portions of the body, and wherein the adjacent outermost side-surfaces through which the first lead portion is exposed are different than the adjacent outermost side-surfaces through which the second lead portion is exposed.

2. The coil component of claim 1, wherein each of the first and second lead portions is disposed in a corner region defining a boundary between one end surface of the body and one side surface of the body connected to the one end surface.

3. The coil component of claim 1, wherein each of the first and second lead portions is exposed to one end surface of the body and to one side surface of the body connected to one end surface thereof.

4. The coil component of claim 1, wherein the first and second lead portions are exposed to different surfaces of the body.

5. The coil component of claim 1, wherein the first and second coil conductors are line-symmetrical to each other with respect to one diagonal of the body.

6. The coil component of claim 1, wherein the coil conductor is formed by an electroplating method.

7. The coil component of claim 1, wherein the body contains a magnetic material.

8. The coil component of claim 1, wherein the body is formed by forming a magnetic material-resin composite containing a mixture of a magnetic metal powder and a resin in a sheet shape and compressing and curing the sheet-shaped magnetic material-resin composite on and below the coil conductor.

9. The coil component of claim 1, wherein a through hole is disposed in a central portion of the support member, and filled with the same material as a material of the body to form a core part.

10. The coil component of claim 1, wherein the first and second lead portions extend continuously from the first and second coil conductors, respectively.

11. The coil component of claim 1, wherein the adjacent outermost side-surfaces are planar and joined at common vertices, respectively.

12. The coil component of claim 11, wherein the first and second lead portions are exposed at the common vertices, respectively.

13. A coil component comprising:

a body in which a support member is disposed; and first and second coil conductors disposed on first and second surfaces of the support member, respectively, the second surface of the support member opposing the first surface thereof, and including first and second lead portions, respectively, wherein the first and second lead portions are disposed in respective corner regions of the body and are each exposed to outside the body through adjacent outermost side-surfaces of the body, wherein the first and second coil conductors are connected to each other through a via hole disposed in the support member, wherein corner regions of the body other than said respective corner regions are spaced apart from the first and second coil conductors by corresponding portions of the body, and wherein the adjacent outermost side-surfaces through which the first lead portion is exposed are different than the adjacent outermost side-surfaces through which the second lead portion is exposed.

14. The coil component of claim 13, wherein the adjacent outermost side-surfaces are planar and joined at common vertices, respectively.

15. The coil component of claim 14, wherein the first and second lead portions are exposed at the common vertices, respectively.

16. The coil component of claim 13, wherein the via hole is disposed in a corner of a square central portion of the support member.

17. The coil component of claim 13, wherein the body has a square-shaped cross section.

18. The coil component of claim 13, further comprising first and second external electrodes disposed on the adjacent outermost side-surfaces of the body and connected to the first and second lead portions, respectively.

19. The coil component of claim 18, wherein the first external electrode is disposed on a first end surface of the body and on portions of side surfaces of the body connected to the first end surface, and the second external electrode is disposed on a second end surface of the body opposing the first end surface of the body and on portions of side surfaces of the body connected to the second end surface.

20. The coil component of claim 13, wherein the first and second lead portions extend continuously from the first and second coil conductors, respectively.

* * * * *